US010301987B2

(12) United States Patent
Soares et al.

(10) Patent No.: US 10,301,987 B2
(45) Date of Patent: May 28, 2019

(54) MULTI-STAGE JET SUCTION PUMP

(71) Applicant: Polytec Plastics Germany GMBH & Co. KG, Lohne (DE)

(72) Inventors: Jorge Soares, Wettringen (DE); Christian Berding, Lohne (DE); Hans Janssen, Dinklage (DE)

(73) Assignee: Polytec Plastics Germany GMBH & Co. KG (DE)

( * ) Notice: Subject to any disclaimer, the term of this patent is extended or adjusted under 35 U.S.C. 154(b) by 0 days.

(21) Appl. No.: 15/542,346

(22) PCT Filed: Jan. 7, 2016

(86) PCT No.: PCT/EP2016/050164
§ 371 (c)(1),
(2) Date: Jul. 7, 2017

(87) PCT Pub. No.: WO2016/113166
PCT Pub. Date: Jul. 21, 2016

(65) Prior Publication Data

US 2018/0274410 A1 Sep. 27, 2018

(30) Foreign Application Priority Data

Jan. 13, 2015 (DE) ..... 10 2015 200 341

(51) Int. Cl.
*F04F 5/22* (2006.01)
*F01M 13/02* (2006.01)
*F04F 5/54* (2006.01)

(52) U.S. Cl.
CPC ..... *F01M 13/021* (2013.01); *F04F 5/22* (2013.01); *F04F 5/54* (2013.01); *F01M 2013/026* (2013.01); *F01M 2013/027* (2013.01)

(58) Field of Classification Search
CPC ..... F01M 13/021; F01M 2013/026; F01M 2013/027; F04F 5/22; F04F 5/54
USPC ..... 123/41.86
See application file for complete search history.

(56) References Cited

U.S. PATENT DOCUMENTS

| | | | | |
|---|---|---|---|---|
| 267,022 | A | 11/1882 | Schutte | |
| 742,618 | A | 10/1903 | Eynon | |
| 1,138,125 | A | 5/1915 | Leblanc | |
| 2011/0073082 | A1 | 3/2011 | Hattori et al. | |
| 2015/0053188 | A1 | 2/2015 | Kuribayashi et al. | |
| 2015/0240732 | A1* | 8/2015 | Makihara | F02D 41/0007 60/602 |
| 2015/0316074 | A1* | 11/2015 | Tell | F04F 5/54 417/54 |

(Continued)

FOREIGN PATENT DOCUMENTS

| | | | |
|---|---|---|---|
| CN | 103930656 | B | 8/2016 |
| DE | 92 10 497 | U1 | 12/1993 |

(Continued)

OTHER PUBLICATIONS

International Search Report for International Application No. PCT/EP2016/050164 dated Apr. 13, 2016.

*Primary Examiner* — Joseph J Dallo
*Assistant Examiner* — Yi-Kai Wang
(74) *Attorney, Agent, or Firm* — Seth L. Hudson; Clements Bernard Walker PLLC

(57) ABSTRACT

The invention relates to a multi-stage jet suction pump for aspirating blow-by gases from internal combustion engines.

4 Claims, 1 Drawing Sheet

(56) References Cited

U.S. PATENT DOCUMENTS

2016/0319732 A1* 11/2016 Iwata ..... F02B 39/005

FOREIGN PATENT DOCUMENTS

| | | | |
|---|---|---|---|
| DE | 44 00 958 | C1 | 4/1995 |
| DE | 198 08 548 | A1 | 9/1999 |
| DE | 20 2006 001 287 | U1 | 6/2007 |
| DE | 10 2010 043 060 | A1 | 5/2012 |
| DE | 10 2013 202 348 | A1 | 8/2013 |
| DE | 11 2011 105 854 | T5 | 8/2014 |
| DE | 10 2013 203 942 | A1 | 9/2014 |
| DE | 10 2014 218 822 | A1 | 3/2015 |
| EP | 2 505 798 | A1 | 10/2012 |
| EP | 2811127 | A1 | 12/2014 |
| WO | 2013/153096 | A1 | 10/2013 |
| WO | 2014/060831 | A2 | 4/2014 |

* cited by examiner

MULTI-STAGE JET SUCTION PUMP

The present invention relates to a multi-stage jet suction pump for aspirating blow-by gases from internal combustion engines.

FIELD OF THE INVENTION

In order to reduce the negative pressure in the engine or to compensate for the pressure rise caused by an oil separator, active pumps for internal combustion engines are employed that actively aspirate blow-by gases, for example, by vacuum pumps or impeller pumps.

A disadvantage of jet suction pumps is their relatively poor efficiency. These pumps only utilize a small portion of the energy fed from the charged region behind the turbocharger in the form of pressurized air.

DE 10 2013 203 942 A1 describes a jet suction pump with a fuel line, a propulsion jet nozzle, an aspiration zone, a mixing tube, and a diffuser, wherein said propulsion jet nozzle and said mixing tube are oriented straight with respect to one another. As viewed in the flow direction, the diffuser has a course that deviates from the course of the mixing tube.

In DE 20 2006 001 287 U1, a jet suction pump that controls the negative pressure for the venting of an internal combustion engine in combination with a pressure control valve is provided as the pump.

In DE 44 00 958 C1, a multi-stage jet suction pump for a fuel pump is provided for improving the function thereof. Because of the multi-stage nature (two-stage, three-stage, four-stage, etc.) of the jet suction pump, the efficiency of the pump can be clearly increased. A liquid is conveyed in this case.

BRIEF SUMMARY OF THE INVENTION

It is the object of the present invention to reduce the negative pressure in the engine, or to compensate for the pressure rise caused by an oil separator.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
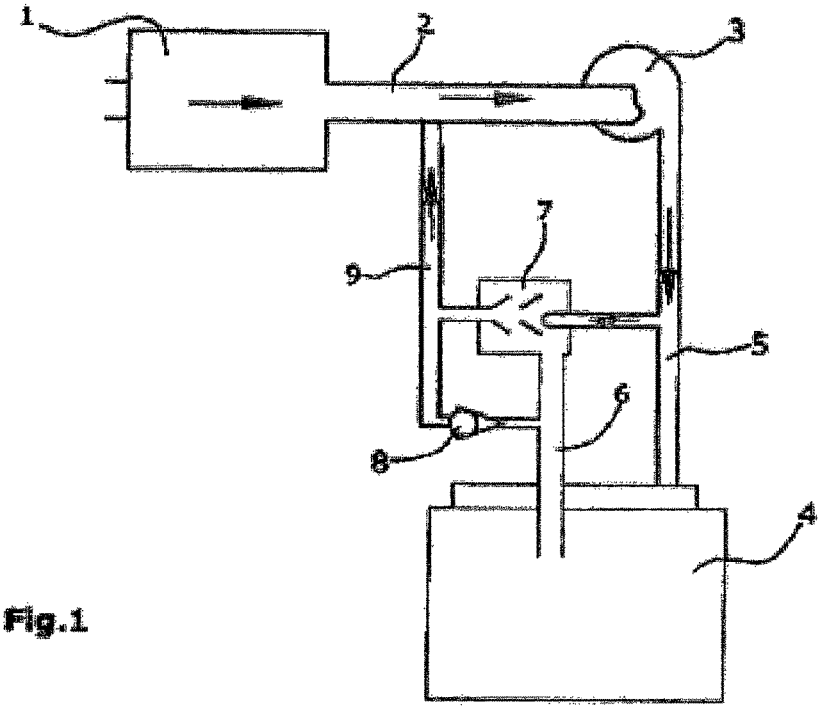
FIG. 1 is an illustration of an embodiment of the present invention.

According to the invention, the above object is achieved in a first embodiment by a jet suction pump 7 for venting an internal combustion engine with a turbocharger 3 between an air filter 1 and a crankcase 4, characterized in that a charge air duct 5 has a branch to an at least two-stage jet suction pump 7, wherein the inlet of said jet suction pump 7 is connected with the crankcase 4 through the engine ventilation 6, and the outlet of said jet suction pump 7 is connected with the suction duct 2 between the air filter 1 and the turbocharger 3 for recirculating blow-by gas 9.

Multi-stage jet suction pumps 7 are particularly suitable for the present purpose, because the absence of moving parts leads one to expect a wear-free pump 7.

The multi-stage pump 7 acts by pressing a propulsion jet (e.g., pressurized air from the charged suction tube) through a small nozzle 10, so that the jet entrains gas at its circumference. After the first stage, the volume flow increased by the supply air is subsequently flowed through a second, larger, nozzle 12 and a third, even larger, nozzle 14, wherein a proportion of gas is again entrained.

At each nozzle 10, 12, 14, the propulsion jet entrains a fraction of the gas to be conveyed (blow-by gas). Because of the multi-stage property, the volume flow conveyed becomes significantly larger (a factor of 2, 3 or more) as with a one-stage jet suction pump. The more, the better.

Because of this improved efficiency, the conveyed volume flow as well as the pressure increase produced by the propulsion jet can be improved.

A basic disadvantage of the jet suction pump 7 is the fact that it also produces a pressure loss in a forced flow mode. The multi-stage property produces a sharply adjusted pump 7 that has no propulsion jet in a case where the internal combustion engine works in non-charged operation.

In this case, the blow-by gas would have to be pressed through the small nozzles, producing a pressure loss that is not desirable. For an optimally constructed multi-stage jet suction pump 7, this pressure loss is significant (5 to 100 mbar depending on the volume flow). Since this drawback may exceed the benefit of the jet suction pump 7, at least one bypass valve 8 and/or one check valve 8 is provided for this application in a preferred embodiment according to the invention, which in a case where the jet suction pump 7 does not produce a propulsion jet, directs the blow-by gas past the pump 7 and thus minimizes the pressure loss for this case.

FIG. 1 shows a preferred embodiment of the present invention. Starting from an air filter 1, the blow-by gas is supplied to the crankcase 4 through the turbocharger 3 and the charge air duct 5. The charge air duct 5 has a branch that discharges into a multi-stage jet suction pump 7. The engine ventilation 6 represents another connection between the crankcase 4 and the jet suction pump 7. In the embodiment that is particularly preferred here, another branch of the engine ventilation 6 leads to a bypass valve 8 and/or a check valve 8 that recirculates the gas flow through the blow-by gas recirculation duct 9 to the suction duct 2 between the air filter 1 and turbocharger 3 when there is a weak or non-existent propulsion jet in the jet suction pump 7.

When the engine works in turbocharging operation, the valve 8 is closed because of the higher pressure downstream the jet suction pump 7. When the engine works in non-charged operation, the blow-by gas can flow past the pump 7 without a pressure loss.

Thus, this operation mode is optimized by a combination of the jet suction pump 7 with the bypass valve 8 and/or the check valve 8.

Figure 2:
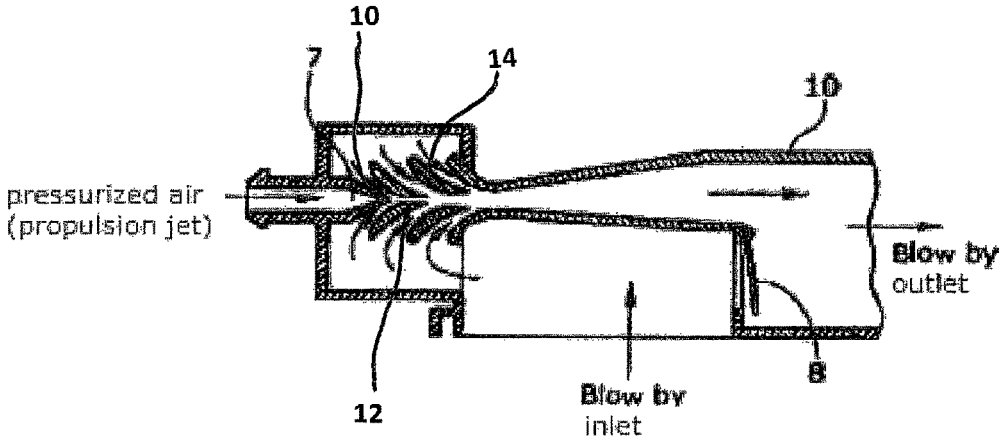
FIG. 2 is an illustration of an embodiment of the present invention wherein the jet pump is inserted into a cylinder head cover.

FIG. 2 shows a preferred embodiment of the present invention in which the jet pump 7 is inserted into a cylinder head cover.

The pump 7 is preferably made of plastic, for example, polyamide. Parts of the pump may also be manifested within the cylinder head cover 10.

In another embodiment of the present invention, the jet suction pump 7 may also be integrated in a cylinder head cover 10.

Alternatively, the complete component may also prepared as a module consisting of the jet suction pump 7 with the bypass valve 8 and/or the check valve 8 with hose connectors.

The invention claimed is:

1. A multi-stage jet suction pump for venting an internal combustion engine with a turbocharger between an air filter and a crankcase, characterized in that a charge air duct has a branch to said multi-stage jet suction pump, wherein the inlet of said multi-stage jet suction pump is connected with the crankcase through the engine ventilation, and the outlet of said jet suction pump is connected with the suction duct between the air filter and the turbocharger for recirculating blow-by gas, the multi-stage pump presses a propulsion jet through a first nozzle entraining gas at a circumference of the first nozzle, the propulsion jet then flows through a second nozzle larger than the first nozzle, and the propulsion jet then flows through a third nozzle, larger than the second nozzle, wherein a proportion of the propulsion jet is entrained, and at least one bypass valve and/or one check valve in the direction of flow parallel to said multi-stage jet suction pump and between said crankcase and said suction duct.

2. The multi-stage jet suction pump according to claim 1, characterized in that said multi-stage jet suction pump has at least 2 stages.

3. The multi-stage jet suction pump according to claim 1, characterized in that at least part of said multi-stage jet suction pump is inside or part of a cylinder head cover.

4. The multi-stage jet suction pump according to claim 1, characterized in that said multi-stage jet suction pump is made of plastic.

* * * * *